US008061584B2

(12) United States Patent
Takemoto et al.

(10) Patent No.: US 8,061,584 B2
(45) Date of Patent: Nov. 22, 2011

(54) STORAGE BOX

(75) Inventors: Naofumi Takemoto, Tokyo (JP); Korehito Tokita, Tokyo (JP); Yuji Sakaya, Tokyo (JP); Kazuhiko Yamashita, Tokyo (JP)

(73) Assignees: Fuji Xerox Co., Ltd., Tokyo (JP); Starway Co., Ltd., Tokyo (JP)

( * ) Notice: Subject to any disclaimer, the term of this patent is extended or adjusted under 35 U.S.C. 154(b) by 588 days.

(21) Appl. No.: 11/717,182

(22) Filed: Mar. 13, 2007

(65) Prior Publication Data

US 2007/0218756 A1 Sep. 20, 2007

(30) Foreign Application Priority Data

Mar. 14, 2006 (JP) ..... P2006-068585

(51) Int. Cl.
*H01R 9/05* (2006.01)

(52) U.S. Cl. ..... 229/117; 439/583; 229/930

(58) Field of Classification Search ..... 229/117, 229/103.3, 108.1, 117.15, 930, 931, 117.05
See application file for complete search history.

(56) References Cited

U.S. PATENT DOCUMENTS 2,165,906 A * 7/1939 Reich ..... 229/108.1
2,294,874 A * 9/1942 Gordon ..... 206/172
3,565,325 A * 2/1971 Pugsley et al. ..... 229/117.05
4,614,266 A * 9/1986 Moorhead ..... 206/216
4,795,085 A * 1/1989 Wein ..... 229/117.03
4,834,255 A * 5/1989 Boots ..... 229/199
4,880,141 A * 11/1989 Gossler et al. ..... 206/600
5,474,230 A * 12/1995 Yotukura ..... 229/117.04
5,690,274 A * 11/1997 Yang ..... 229/117
5,820,017 A * 10/1998 Eliovson et al. ..... 229/217
6,309,039 B1 * 10/2001 Park et al. ..... 312/258
2005/0087590 A1 4/2005 Kawagoe et al.

FOREIGN PATENT DOCUMENTS

CN 2695363 Y 4/2005

(Continued)

OTHER PUBLICATIONS

*Nikkei Monozukuri*, Oct. 2006, pp. 90-92, Returnable packaging box which can be easily recovered [Fuji Xerox Co., Ltd.]. Folded boxes can be stored in a box with the exact same dimensions. (partial English-language translation).

*Primary Examiner* — Nathan J. Newhouse
*Assistant Examiner* — Christopher Demeree
(74) *Attorney, Agent, or Firm* — Morgan, Lewis & Bockius LLP

(57) ABSTRACT

A storage box includes a main body portion. The main body portion includes long longitudinal plate portions, short longitudinal plate portions, bottom plate portions that are continued from the long longitudinal plate portions and the short longitudinal plate portions, respectively, and lid portions that are continued from the long longitudinal plate portions and the short longitudinal plate portions, respectively. The long longitudinal plate portions are respectively formed with first valley-folding portions which extend in an upper and lower direction. The bottom plate portions continued from the tong longitudinal plate portions are formed with mountain-folding portions on extended lines of the first valley-folding portions. The lid portions continued from the long longitudinal portions are formed with second valley-folding portions on the extended lines of the first valley-folding portions.

12 Claims, 15 Drawing Sheets

FOREIGN PATENT DOCUMENTS

| | | |
|---|---|---|
| JP | 62-110119 | 7/1987 |
| JP | 10-218159 | 8/1998 |
| JP | 11-147253 | 6/1999 |
| JP | 11-263332 | 9/1999 |
| JP | 2002-234542 | 8/2002 |
| JP | 2003-112789 | 4/2003 |
| JP | 2005-29176 | 2/2005 |
| JP | 2006-008157 | 1/2006 |

* cited by examiner

STORAGE BOX

CROSS-REFERENCE TO RELATED APPLICATIONS

This application is based on and claims priority under 35 U.S.C. §119 from Japanese Patent Application No. 2006-068585 filed Mar. 14, 2006.

BACKGROUND

1. Technical Field

The invention relates to a storage box for packing, and particularly to a paper storage box intended for repeated use.

2. Related Art

When various articles such as machines, electric appliances or commodities are transported, storage boxes are used. Conventionally, these storage boxes are manufactured on the premise that they are disposable. Recently, the environmental problem has come into the limelight. Thus, it is desired not to throw away but to recover and reuse the storage boxes.

SUMMARY

According to an aspect of the invention, a storage box includes a main body portion. The main body portion includes a pair of long longitudinal plate portions, a pair of short longitudinal plate portions, bottom plate portions and a lid portions. The bottom plate portions are continued from the long longitudinal plate portions and the short longitudinal plate portions, respectively. The lid portions are continued from the long longitudinal plate portions and the short longitudinal plate portions, respectively. The pair of long longitudinal plate portions are respectively formed with first valley-folding portions which extend in an upper and lower direction and which are formed to fold the long longitudinal plate portions inwardly. The bottom plate portions continued from the long longitudinal plate portions are formed with mountain-folding portions so that the mountain-folding portions are located on extended lines of the first valley-folding portions. The mountain-folding portions are formed to fold the bottom plate portions inwardly. The lid portions continued from the long longitudinal portions are formed with second valley-folding portions so that the second valley-folding portions are located on the extended lines of the first valley-folding portions. The second valley-folding portions are formed to fold the lid portions inwardly. The main body portion can be folded by raising or folding down the lid portions while raising the bottom plate portions upward and by folding the first valley-folding portions, the mountain-folding portions and the second valley-folding portions.

BRIEF DESCRIPTION OF THE DRAWINGS

Exemplary embodiments of the invention will be described in detail below with reference to the accompanying drawings, wherein.

DETAILED DESCRIPTION

Hereinafter, exemplary embodiments of the invention will be described with reference to the accompanying drawings.

FIGS. 1A to 10 show a storage box according to an exemplary embodiment of the invention.

The configuration will be described first of all. A storage box 1A of this embodiment is formed into a mode shown in a perspective view of FIG. 2 by combining: a first member 1C, an extended state of which is shown in FIG. 1A; a second member 1D, an extended state of which is shown in FIG. 1B; and a third member 1E, an extended state of which is shown in FIG. 1C.

These first member 1C, the second member 1D and the third member 1E are formed of a highly strong, durable and waterproof paper board (substantially having a density 1.1 ($g/cm^3$), a tensile strength of T60, Y35 (MPa), a coefficient of extension of T6.2, Y7.0(%) and an absorption coefficient of 50(%)), which is formed by compression-molding recycled waste paper. The paper board is formed to have a thickness of about 2 mm, but may have a larger or smaller thickness. The first member 1C, the second member 1D and the third member 1E thus formed by compression-molding the recycled waste-paper are so highly strong that the storage box 1A has a high resistance to the repeated uses. Moreover, the storage box 1A can be manufactured at a low cost.

Figure 1A:
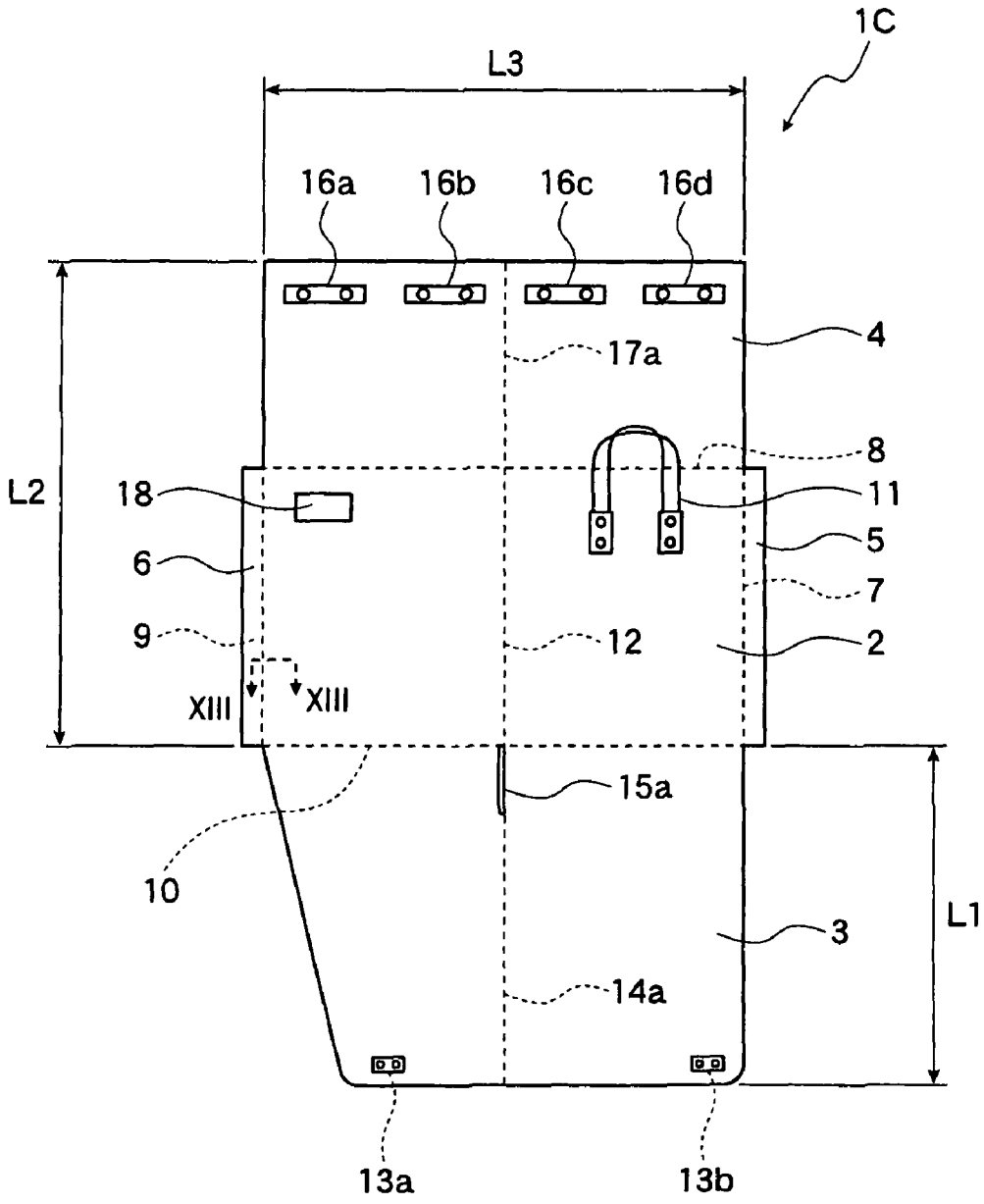
FIG. 1A is a development view of a first member that forms a storage box according to an embodiment of the invention.
Figure 1B:
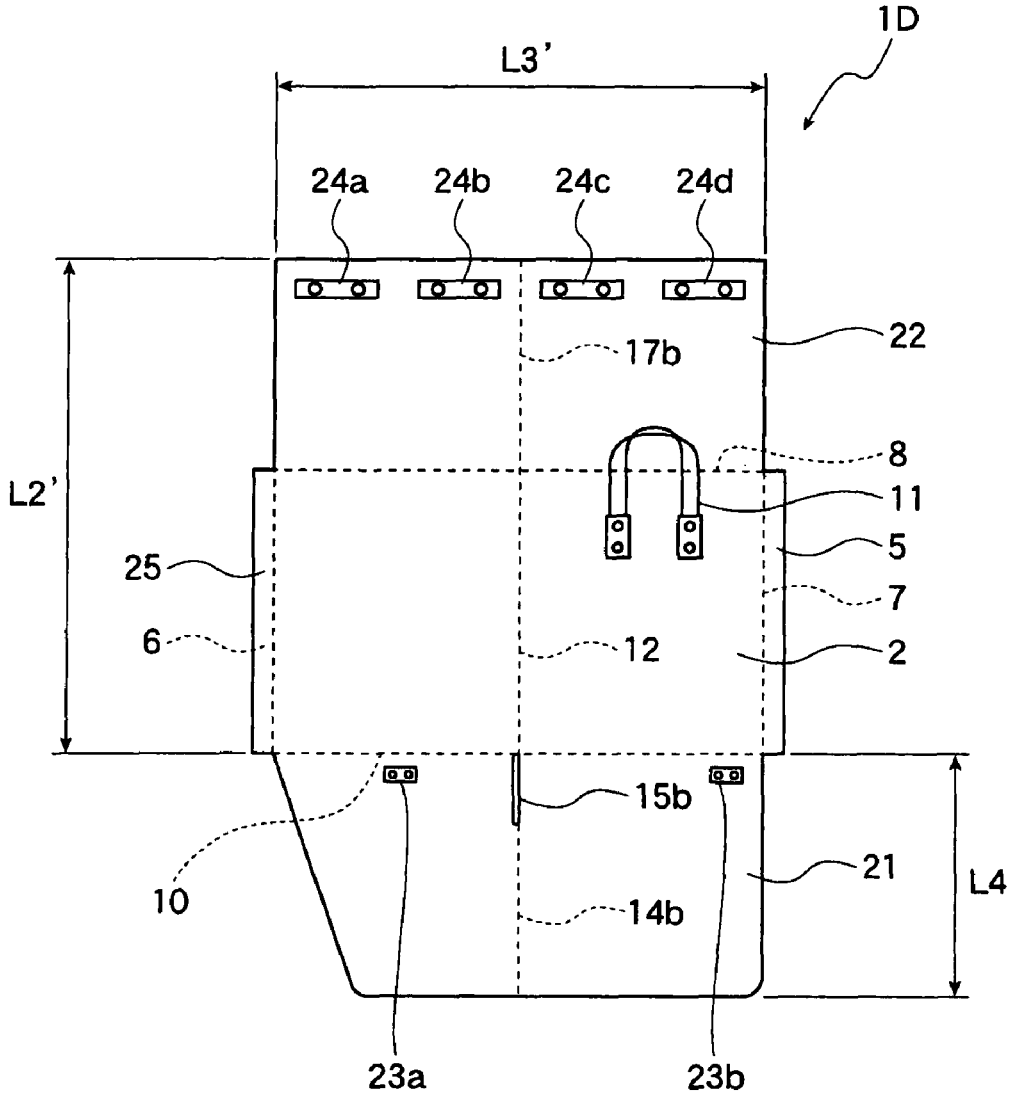
FIG. 1B is a development view of a second member that forms the storage box.
Figure 1C:
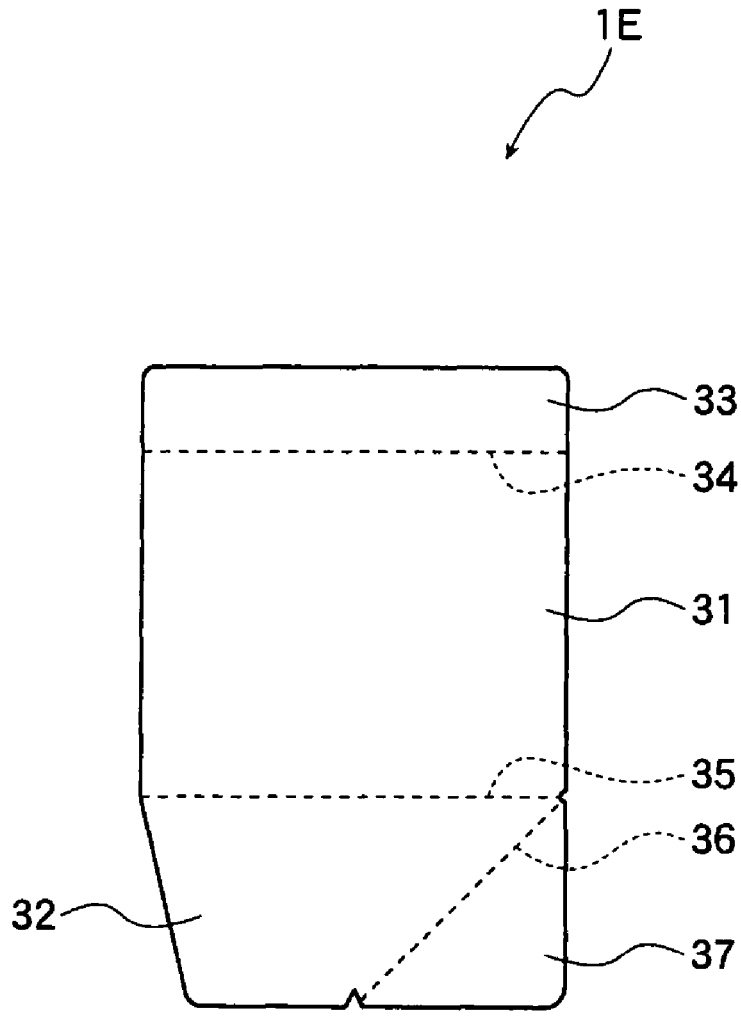
FIG. 1C is a development view of a third member that forms the storage box.

As shown in FIG. 1A, the first member 1C is provided, above and below a long longitudinal plate portion 2, with a first long bottom plate portion 3 and a lower lid portion 4 and, on the left and right sides of the long longitudinal plate portion 2, with binding margin portions 5 and 6.

Figure 11A:
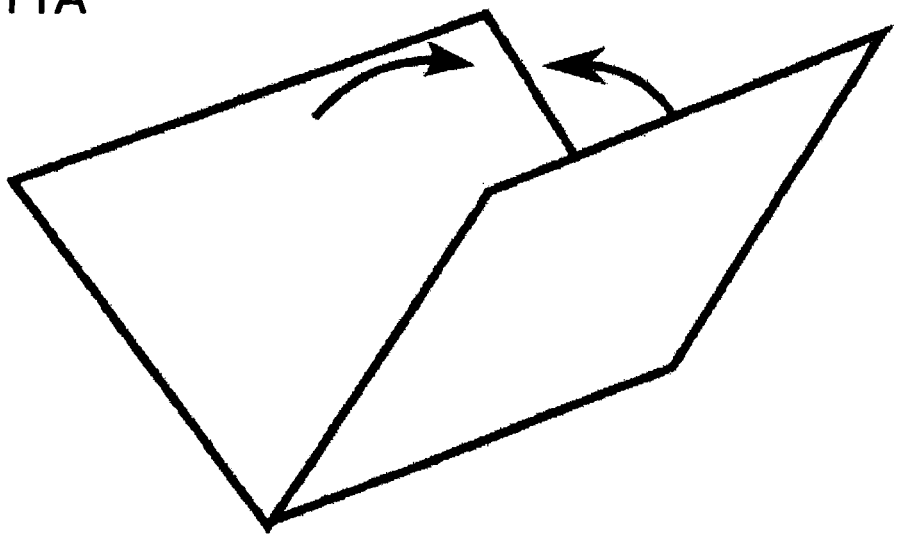
FIG. 11 is a diagram for explaining the definitions of "valley folding" and "mountain folding"
Figure 11B:
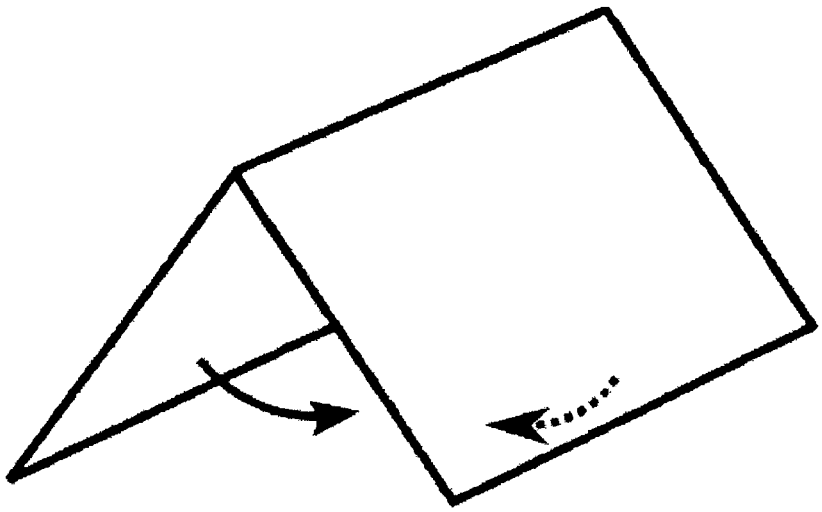
Figure 12:
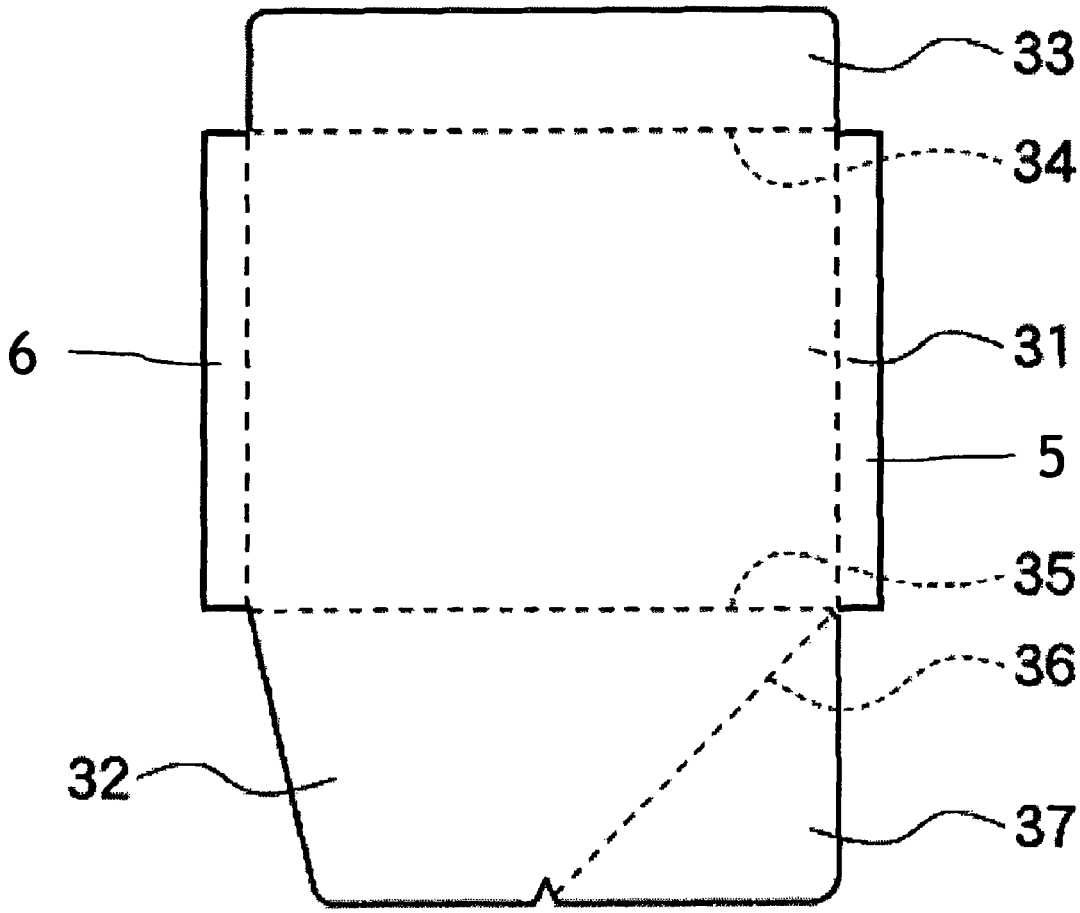
FIG. 12 is a diagram showing a modification of the embodiment.

Folding portions 7, 8, 9 and 10 are formed at the four sides of the long longitudinal plate portion 2. A grip portion 11 made of nylon is attached to the upper right end of the long longitudinal plate portion 2, and an Integrated Circuit TG tag 18 for recording various pieces of management information is attached to the upper left end. A first valley folding portion 12 for folding the long longitudinal plate portion 2 inward onto itself is so formed at a central portion of the long longitudinal plate portion 2 as to extend upward and downward of FIG. 1A. The term "valley folding" means folding a paper forward onto itself as shown in FIG. 11A. The term "mountain folding" means folding a paper rearward onto itself as shown in FIG. 11B. In FIGS. 1A to 1C, 4, 5 and 9, "forward" is defined as a direction from the rear side of each drawing sheet to the front side, and "reward" is defined as a direction from the front side of each drawing sheet to the rear side.

The first long bottom plate portion 3 is formed to have a longitudinal length L1 substantially equal to the transverse length L1 (FIG. 10) in a front elevational view at the time when the storage box is viewed from the side of a short longitudinal plate portion, and hook-and-loop fasteners 13*a* and 13*b* are attached to the two portions (on the rear side in FIG. 1A) of the leading end portion. A first mountain folding portion 14*a* is formed upward and downward at such a position of the central portion of the first long bottom plate portion 3 as to continue to the first valley folding portion 12. Between the first valley folding portion 12 and the first mountain folding portion 14*a*, moreover, slit 15*a* or cut is formed in the continued direction (i.e., in the longitudinal direction) of the first mountain folding portion 14*a*.

Figure 8:
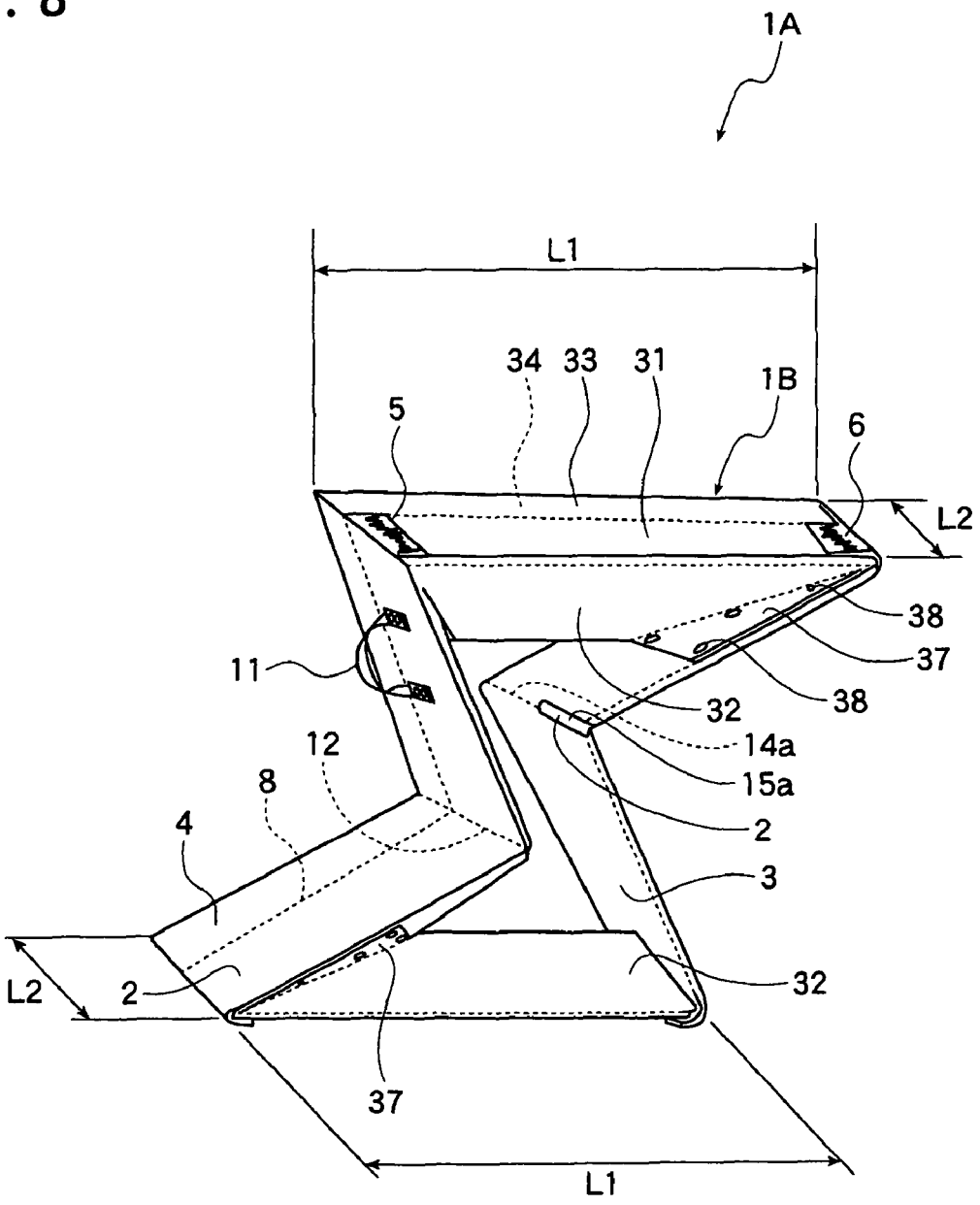
FIG. 8 is a perspective view, as taken from the bottom face, of a state where the body portion of the storage box is being folded.

Hook-and-loop fasteners 16*a*, 16*b*, 16*c* and 16*d* are attached to four portions of the end portion of the lower lid portion 4. In the lower lid portion 4, moreover, a second valley folding portion 17*a* is formed, at a position continued to the first valley folding portion 12, to extend upward and downward of FIG. 1A. When the folding portion 10 is mountain-folded in FIG. 1A while the first valley folding portion 12 and the second valley folding portion 17*a* are valley-folded, the first member 1C is folded to be stored inside of the body portion 1B as shown in FIG. 8.

Moreover, the longitudinal length L2 of a combination of the long longitudinal plate portion 2 and the lower lid portion 4, the transverse length L3 of the long longitudinal plate portion 2 and the transverse length L3 of the lower lid portion 4 are made substantially equal to each other.

As shown in FIG. 1B, the second member 1D is provided, above and below the long longitudinal plate portion 2, with a second long bottom plate portion 21 and an upper lid portion 22 and, on the left and right sides of the long longitudinal plate portion 2, with the binding margin portions 5 and 6.

The second long bottom plate portion 21 is formed to have a longitudinal length L4 shorter than the transverse length L1 (FIGS. 1A and 2), taken in the front elevational view, of the body portion 1B, and hook-and-loop fasteners 23*a* and 23*b* are attached to two portions (on the surface side of FIG. 1B) of the base end portion. At a position, continued to the first valley folding portion 12, of the central portion of the second long bottom plate portion 21, moreover, a first mountain folding portion 14*b* is formed to extend upward and downward of FIG. 1B. Between the first valley folding portion 12 and the first mountain folding portion 14*b*, moreover, a slit 15*b* or cut is formed in the continued direction (i.e., in the longitudinal direction) of the first mountain folding portion 14*b*.

Hook-and-loop fasteners 24*a*, 24*b*, 24*c* and 24*d* are attached to the four portions of the end portion of the upper lid portion 22. In the upper lid portion 22, moreover, a second valley folding portion 17*b* is formed at a portion continued to the first valley folding portion 12 to extend upward and downward of FIG. 1B.

Moreover, a longitudinal length L2' of a combination of the long longitudinal plate portion 2 and the upper lid portion 22, a transverse length L3' of the long longitudinal plate portion 2 and the transverse length L3' of the upper lid portion 22 are equal to each other. Here, these longitudinal length L2' and the transverse length L3' are equal to the longitudinal length L2 and the transverse length L3 shown in FIG. 1A (Hence, in the following description, L2' is collectively referred to as L2, and L3' is collectively referred to as L3).

As shown in FIG. 1C, the third member 1E is provided, above and below a short longitudinal plate portion 31, with a short bottom plate portion 32 and a flap 33.

The short longitudinal plate portion 31 is formed with folding portions 34 and 35 in its upper side and lower side. The short bottom plate portion 32 is formed with a fourth valley folding portion 36 as a folding portion for raising up the short bottom plate portion 32. The fourth valley folding portion 36 extends obliquely in FIG. 1C from the central portion of the leading end portion (i.e., the end portion of the lower side of FIG. 1C) of the short bottom plate portion 32 to the base end portion (or the end portion on the side of the short bottom plate portion 31). Moreover, an angle between the folding portion 35 and the fourth valley folding portion 36 is about 45 degrees. A substantially triangular area of the short bottom plate portion 32, which is surrounded by the fourth valley folding portion 36, one side of the leading end side and one side of the right side, forms a fixing face 37 which will be fixed to the first long bottom plate portion 3 or the second long bottom plate portion 21.

Figure 2:
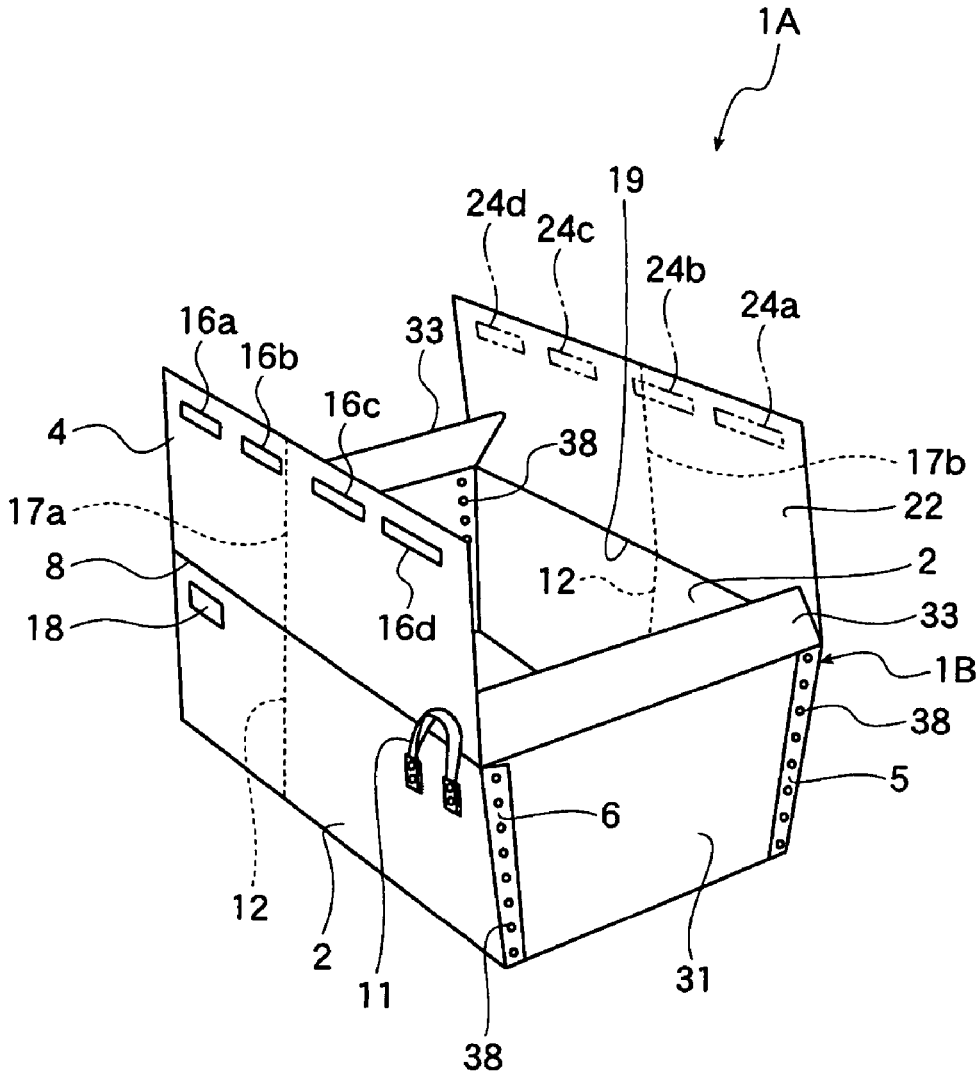
FIG. 2 is a perspective view of a state where a body portion of the storage box is extended.

The body portion 1B of the storage box 1A of this embodiment, a perspective view of which is shown in FIG. 2, is formed by combining one sheet of the first member 1C, one sheet of the second member 1D and two sheets of the third member 1E. The method for assembling the body portion 1B of the storage box 1A will be described below.

At first, the first member 1C and the second member 1D are arranged so that their rear faces (i.e., the faces not appearing in FIG. 1A and FIG. 1B) are spaced to confront each other. At the two end portions of the first member 1C and the second member 1D, moreover, a pair of third members 1E are arranged so that they are spaced to confront each other.

Figure 3:
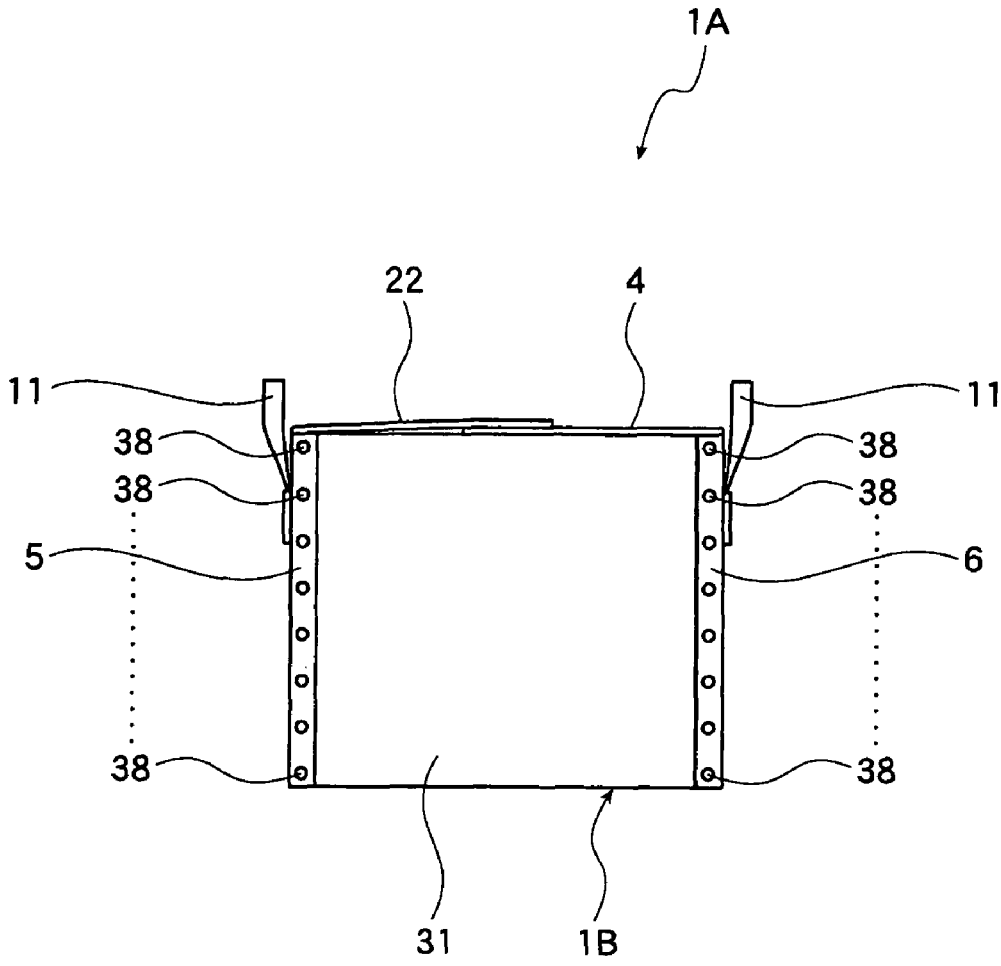
FIG. 3 is a front elevational view of a state where a body portion of the storage box is extended.

In this state, the binding margin portion 5 (or 6) of the first member 1C and the binding margin portion 6 (or 5) are brought into abutment against the two side portions of the surface of the short longitudinal plate portion 31 of the third member 1E as shown in FIG. 3, and the first member 1C (and the second member 1D) is fixed to the third member 1E by screws 38, 38, - - - , and 38.

Next, the fixing face 37 of the short bottom plate portion 32 of one of the third members 1E is brought into abutment against the first long bottom plate portion 3 of the first member 1C (with the body portion 1B being extended), and the fixing face 37 and the first long bottom plate portion 3 are fixed by the screws 38. Likewise, moreover, the fixing face 37 of the short bottom plate portion 32 of the other third member 1E is brought into abutment against the second long bottom plate portion 21 of the second member 1D, and the fixing face 37 and the second long bottom plate portion 21 are fixed by the screws 38 (see FIG. 7). As a result, the body portion 1B of the storage box 1A is completed.

Next, the actions to unfold the storage box 1A and the actions to fold the storage box 1A will be described.

Firstly, the description is made on the action to unfold the body portion 1B of the storage box 1A. At first, the pair of long longitudinal plate portions 2 and 2 are spaded to confront each other, and the pair of short longitudinal plate portions 31 and 31 are spaced to confront each other (see FIG. 7) to thereby form the body portion 1B into a substantially rectangular shape in plan view (see FIG. 3). Next, the second long bottom plate portion 21 is placed on the upper faces of the short bottom plate portions 32 and 32, and the first long bottom plate portion 3 is placed on the upper face of the second long bottom plate portion 21 (see FIGS. 3 and 7). Then, the hook-and-loop fasteners 23*a* and 23*b* of the second long bottom plate portion 21 and the hook-and-loop fasteners 13*a* and 13*b* of the first long bottom plate portion 3 are brought into engagement, to thereby complete the unfolded state of the body portion 1B (see FIG. 2).

Figure 6:
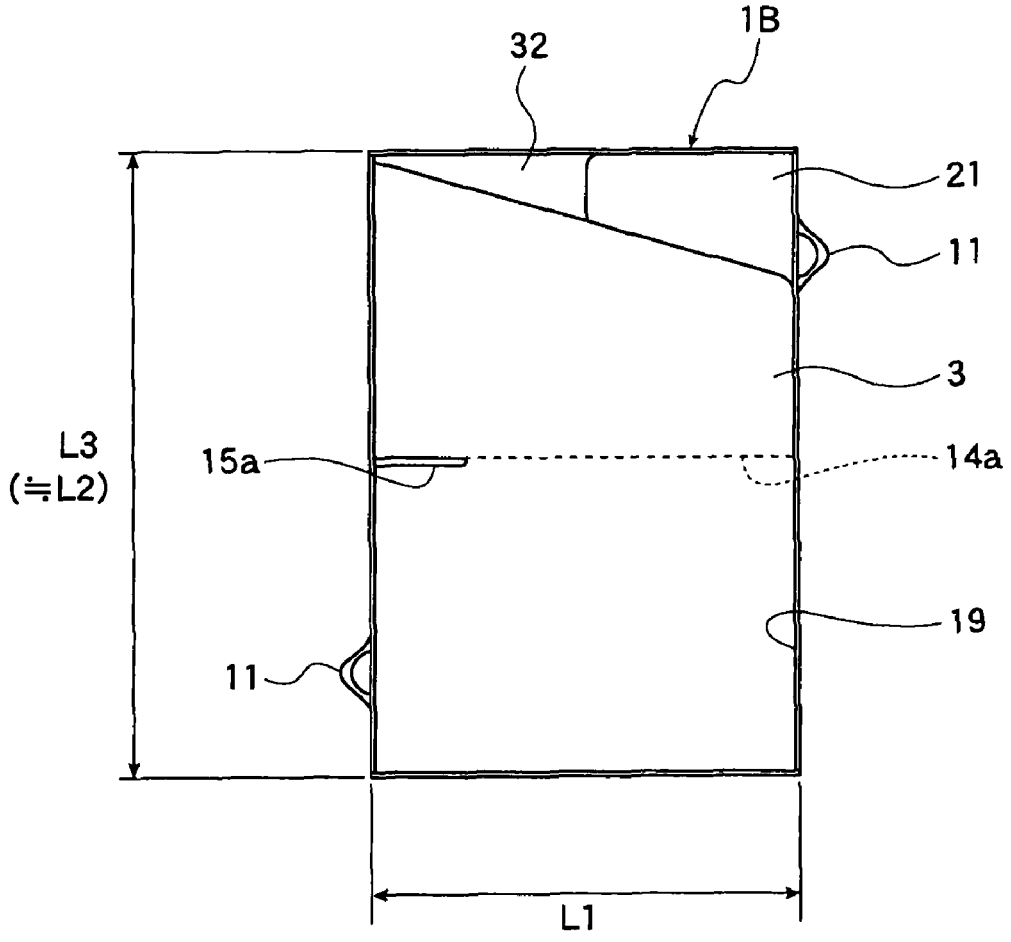
FIG. 6 is a top plan view of a state where the body portion of the storage box is extended with the lid portion being unfolded.
Figure 7:
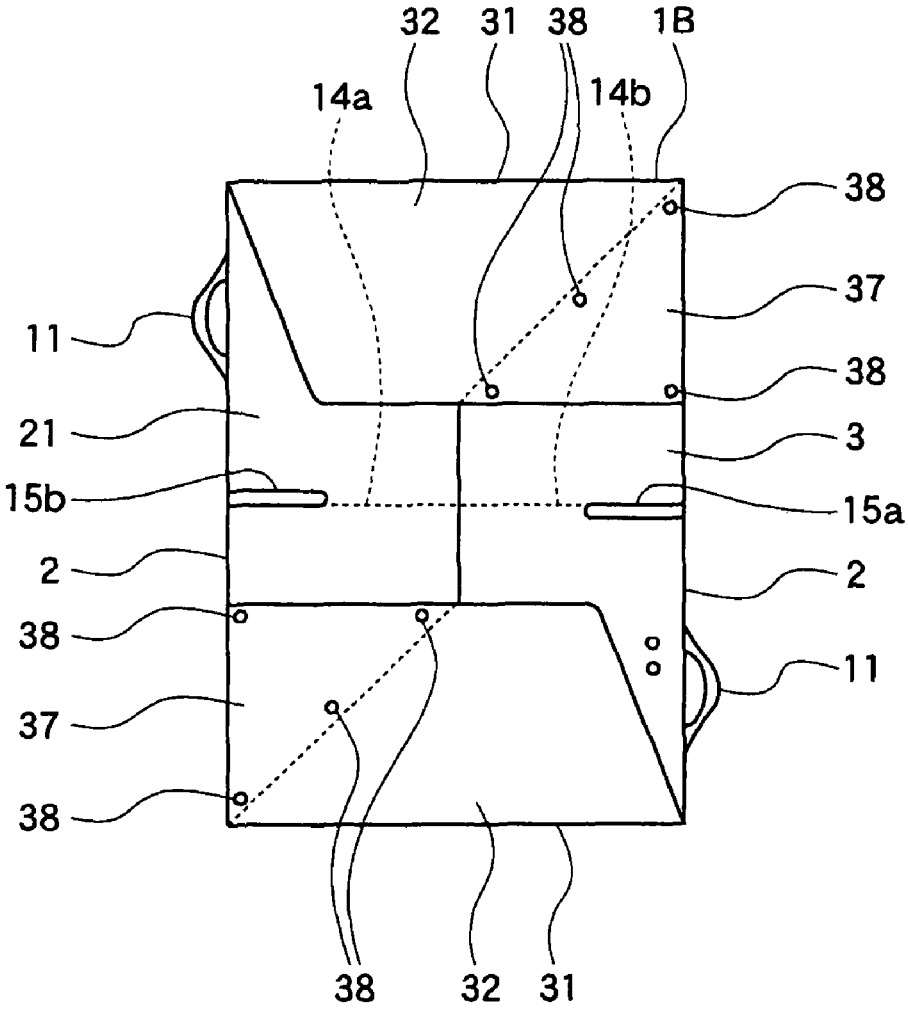
FIG. 7 is a bottom plan view of a state where the body portion of the storage box is extended.

In this state where the body portion 1B is unfolded, the first long bottom plate portion 3 placed on the second long bottom plate portion 21 covers substantially all over the bottom face (see FIG. 6). Therefore, the bottom face of the body portion 1B can be made so strong as to enhance the resistance of the storage box 1A to a load.

Figure 4:
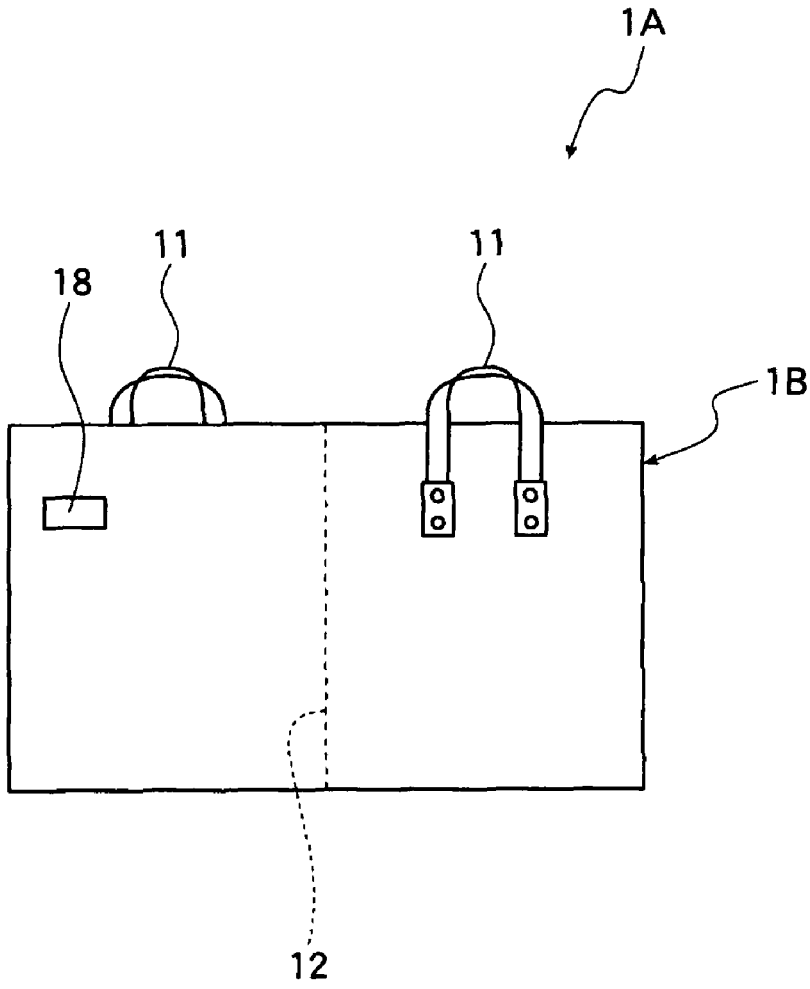
FIG. 4 is a side elevational view of the state where the body portion of the storage box is extended.
Figure 5:
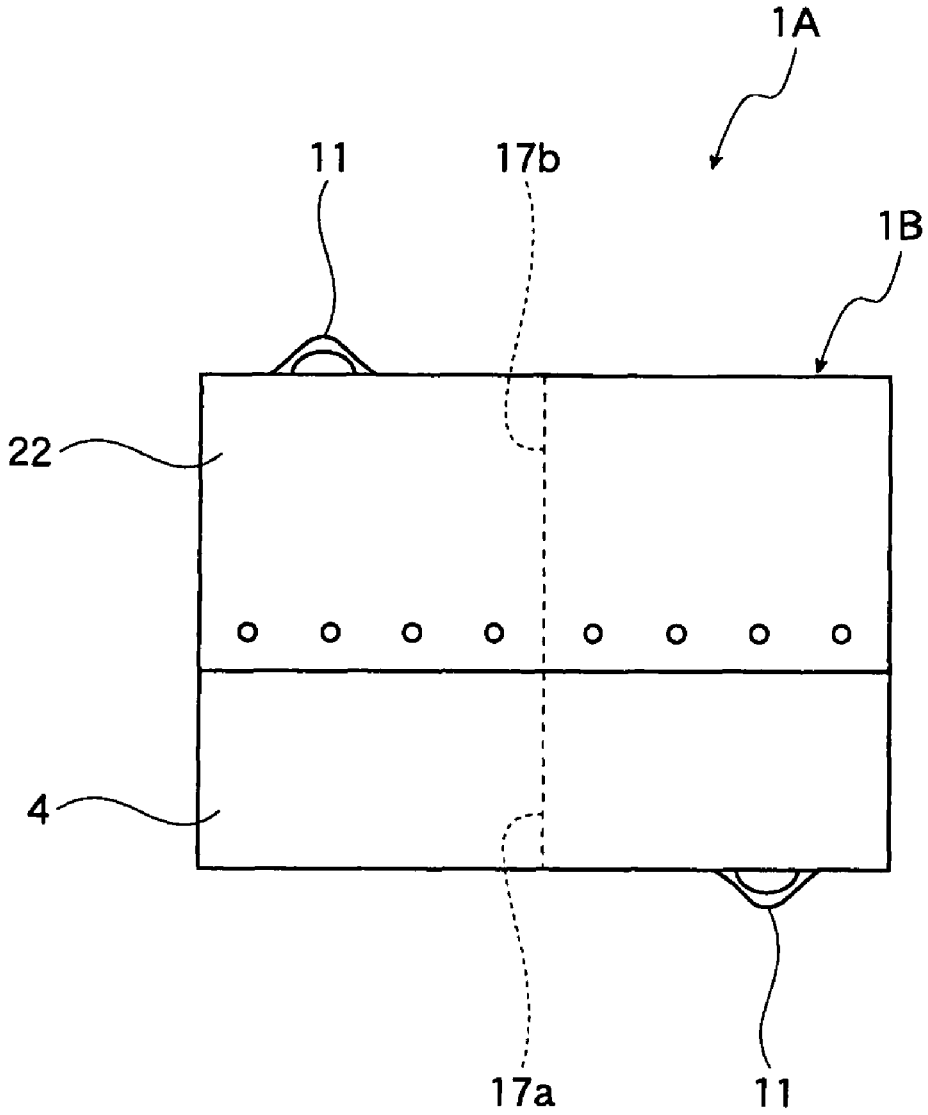
FIG. 5 is a top plan view of a state where the body portion of the storage box is extended with a lid portion being closed.

When the body portion 1B is to be covered while being unfolded, moreover, an opening portion 19 (see FIG. 2) of the body portion 1B is covered with the lower lid portion 4 and the upper lid portion 22 in this order to bring the storage box 1A in a state shown in FIGS. 3 to 5. Then, the hook-and-loop fasteners 16*a*, 16*b*, 16*c* and 16*d* of the lower lid portion 4 and the hook-and-loop fasteners 24*a*, 24*b*, 24*c* and 24*d* of the upper lid portion 22 are brought into engagement (see FIG. 2).

Secondly, the method for folding the body portion 1B will be described. At first, in the state shown in FIGS. 3 to 5, the hook-and-loop fasteners 16*a*, 16*b*, 16*c* and 16*d* of the lower lid portion 4 and the hook-and-loop fasteners 24*a*, 24*b*, 24*c* and 24*d* of the upper lid portion 22 are disengaged. Moreover, the hook-and-loop fasteners 23*a* and 23*b* of the second long bottom plate portion 21 and the hook-and-loop fasteners 13*a* and 13*b* of the first tong bottom plate portion 3 are disengaged.

Next, the lower lid portion 4, the upper lid portion 22 and the flaps 33 and 33 are individually raised upward (see FIG. 2). As the first long bottom plate portion 3 and the second long bottom plate portion 21 are raised upward, the first valley folding portion 12, the first mountain folding portions 14*a* and 14*b* and the second valley folding portions 17*a* and 17*b* are respectively valley-folded. Then, the central portions of the long longitudinal plate portions 2 of the first and second members 1C and 1D are moved in directions so as to come close to each other, and the first tong bottom plate portion 3 and the second long bottom plate portion 21 are raised upward. Moreover, the short bottom plate portions 32 and 32 are raised upward while the fourth valley folding portion 36 being valley-folded, because the first long bottom plate portion 3 and one short bottom plate portion 32 and the second long bottom plate portion 21 and the other bottom plate portion 32 are fixed by the fixing face 37. As a result, the body portion 1B is substantially formed into a shape of letter "Z," as viewed from the bottom face (see FIG. 8).

Figure 9:
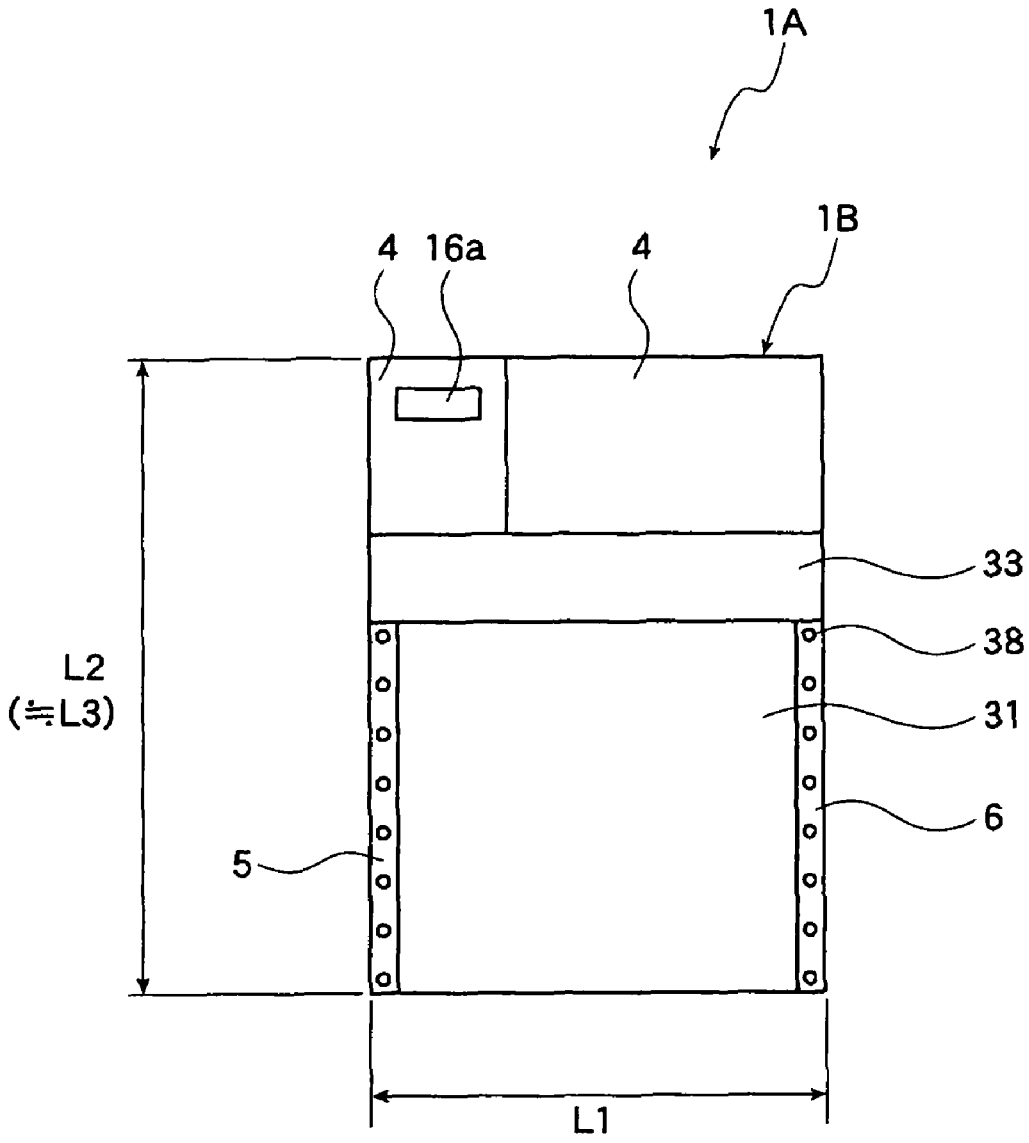
FIG. 9 is a view, as taken from the front face (from the face side of a short longitudinal plate portion), of a state where the body portion of the storage box is being folded.

Moreover, the positions where the first mountain folding portions 14*a* and 14*b* are formed are located to overlap the first valley folding portion 12 substantially, when the bottom plate portions are raised upward. On the other hand, the positions where the second valley folding portions 17*a* and 17*b* are formed are substantially located at the positions where the first valley folding portion 12 is extended (see FIGS. 1A and 1B). As a result, the body portion 1B is finally folded into a substantially planar compact shape as shown in FIG. 9, while the first folding portion 12, the first mountain folding portion 14*a* (or 14*b*) and the second valley folding portion 17*a* (or 17*b*) overlapping substantially at an identical position. At this time, the short longitudinal plate portions 31 overlap substantially at an identical position in plan view (see FIG. 10).

In this folded state, the long longitudinal plate portion 2 and the first long bottom plate portion 3 (or the second long bottom plate portion 21) overlap (see FIG. 8) so that the long longitudinal plate portion 2 is located on the inner side of the valley fold along the first valley folding portion 12 and the second valley folding portion 17*a* (or 17*b*) and the first long bottom plate portion 3 (or the second long bottom plate portion 21) is located on the outer side of the valley fold along the first valley folding portion 12 and the second valley folding portion 17*a* (or 17*b*). Therefore, a strong bending stress is applied to the first mountain folding portion 14*a* (14*b*) located on the outer side of the valley fold. In this body portion 1B, however, the first long bottom plate portion 3 and the second long bottom plate portion 21 are formed with the slit 15*a* (or 15*b*) in the vicinity of the long longitudinal plate portion 2 on the extension of the first mountain folding portion 14*a* (or 14*b*), to which the strong bending stress is applied. As a result, the bending stress of that portion when folded is applied to in a range from the peripheral portion of the slit 15*a* (or 15*b*) to the first long bottom plate portion 3 and the second long bottom plate portion 21. At this time, the slit 15*a* (or 15*b*) expands in the tensile direction to thereby perform an action to relax the bending stress applied to the first long bottom plate portion 3 and the second long bottom plate portion 21. Thus, the first long bottom plate portion 3 and the second long bottom plate portion 21 is prevented from being broken by the bending stress when the body portion 1B is folded up.

The entire shape, as viewed from the front face side (or the face side of the short longitudinal plate portion 31) with the body portion 1B being folded up, is substantially rectangular as shown in FIG. 9. In this entire shape, moreover, the length L1 of the shorter side (or one side) is the length (L1) of one side of the opening portion 19 at the time when the body portion 1B is unfolded, and the length L2 of the longer side (or the other side) adjoining the shorter side is the sum of the long longitudinal plate portion 2 and the lower lid portion 4. The length L2 of the longer side is substantially equal to the length L3 (see FIG. 6) of the longer side of the opening portion 19 when the body portion 1B is unfolded.

Figure 10:
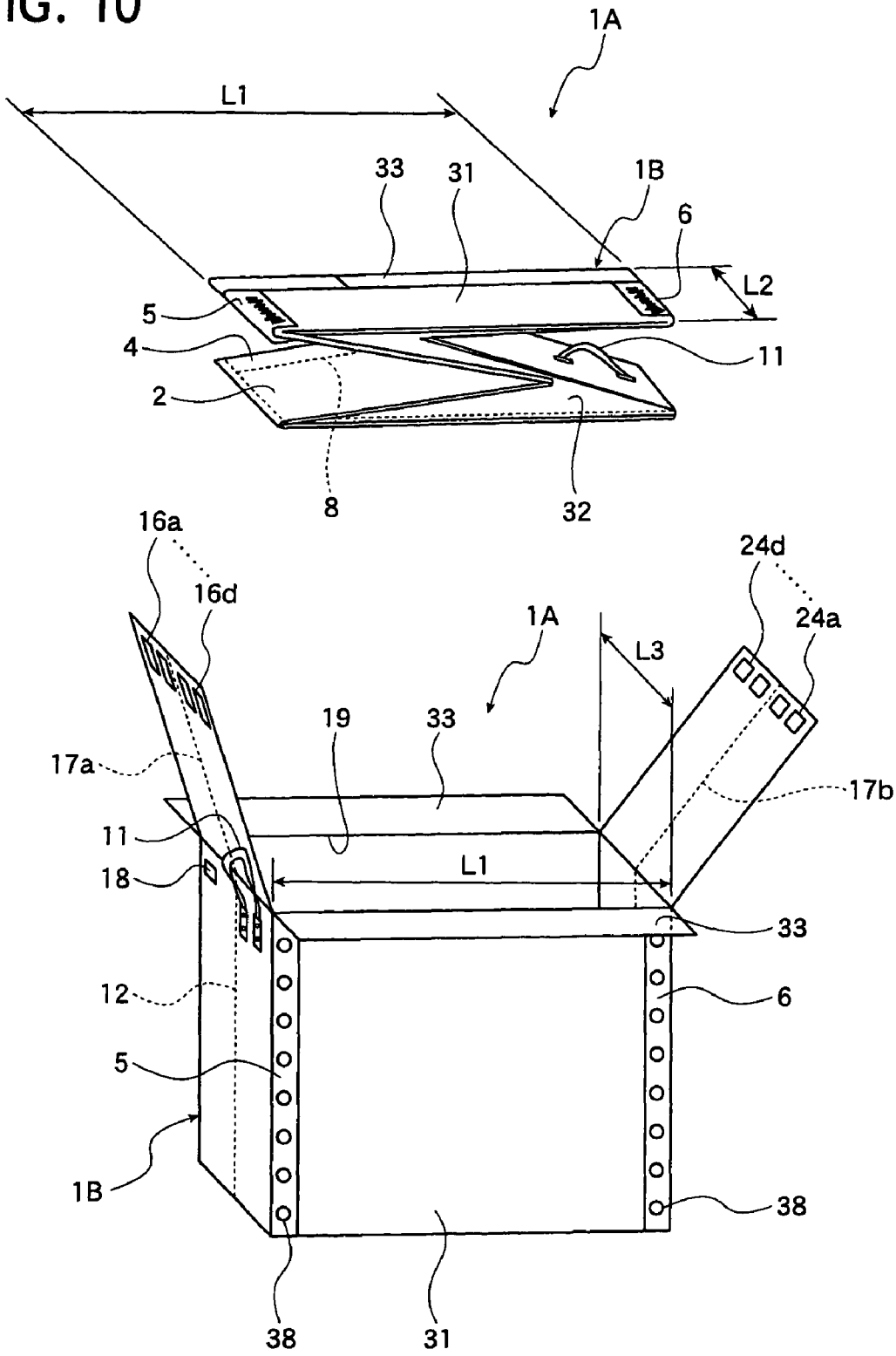
FIG. 10 is a perspective view showing a mode where the folded storage box is stored in an unfolded storage box.

Specifically, the length L1 of the shorter side when the body portion 1B is folded up is equal to or less than the length L1 of the shorter side of the opening portion 19 when the body portion 1B is unfolded, and the length L2 of the longer side when the body portion 1B is folded up is equal to or less than the length L3 of the longer side of the opening portion 19 when the body portion 1B is unfolded. As shown in FIG. 10, therefore, the folded body portion 1B can be stored in the unfolded body portion 1B. In addition, the opening portions 19 of the folded body portion 1B and the unfolded body portion 1B are equal in their shorter side lengths L1 and L1 and in their longer side lengths L2 and L3. As shown in FIG. 10, therefore, the folded body portion 1B can be stored without any substantial gap in the unfolded body portion 1B.

Figure 13A:
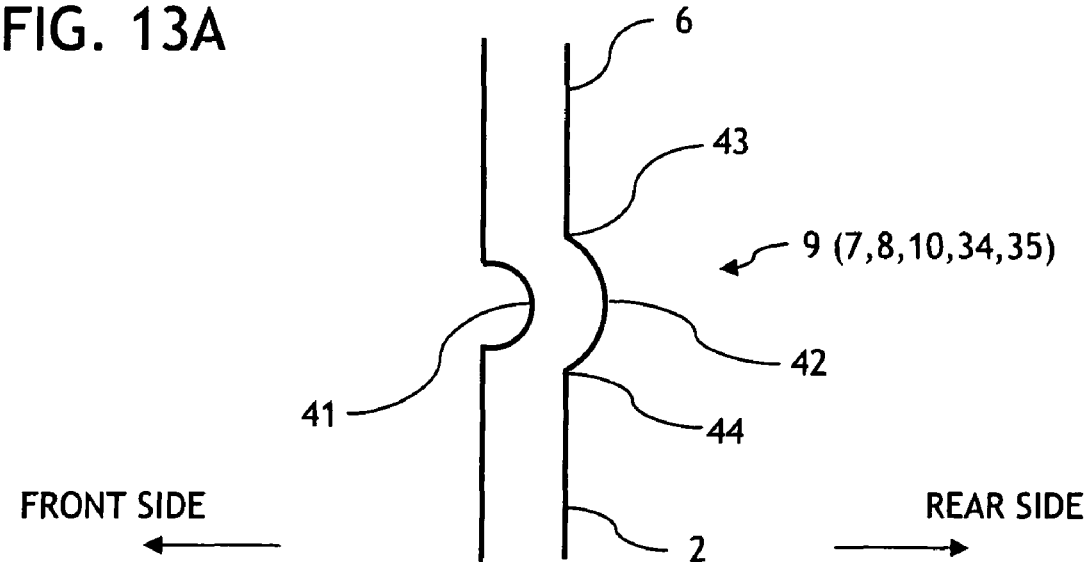
FIG. 13 is sectional views taken along XIII-XIII of FIG. 1A.

With reference to FIG. 13, moreover, one example of the folding portions 7-10, 34 and 35 according to this embodiment will be described. In the following, the folding portion 9 will be described for simplifying the description, but the remaining folding portions 7, 8, 10, 34 and 35 have similar structures. FIG. 13A is a sectional view taken along XIII-XIII of FIG. 1A, that is, a sectional view of the folding portion 9 taken along a direction perpendicular to the direction in which the folding portion 9 extends in a state where the first member 1C is being extended as shown in FIG. 1A. As shown in FIG. 13A, the folding portion 9 has a concave portion 41 and a convex portion 42. The concave portion 41 is opened toward the front side of the first member 1C (i.e., the left side of FIG. 13A). The convex portion 42 is protruded toward the rear side of the first member 1C (i.e., the right side of FIG. 13A). The convex portion 42 is connected at an end portion 43 to the binding margin portion 6 and at an end portion 44 to the long longitudinal plate portion 2. The first member 1C is mountain-folded at the folding portion 9 along the end portions 43 and 44 (see FIGS. 11A and 11B).

Figure 13B:
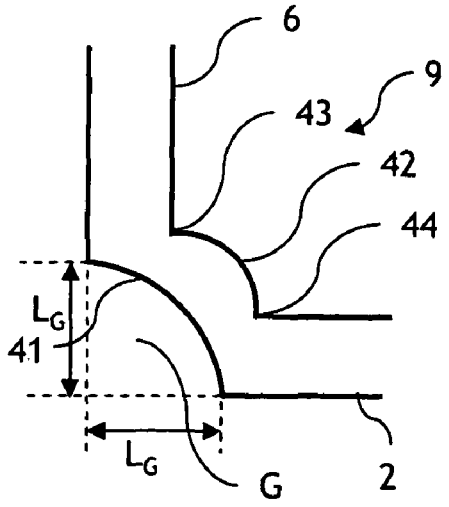

FIG. 13B is a sectional view taken along XIII-XIII of FIG. 1 at the time when the body portion 1B of the storage box 1A is assembled into the box shape. The concave portion 41 of the folding portion 9 extends in parallel with the long longitudinal plate portion 2 by a length $L_G$ toward the outer side of the long longitudinal plate portion 2. Thus, the binding margin portion 6 is located at outer position than the tong longitudinal plate portion 2. When the body portion 1B is assembled into the box shape, therefore, the length of the body portion 1B in the longitudinal direction (i.e., in the longitudinal direction of FIG. 6) in plan view is equal to the sum of the length of the long longitudinal plate portion 2 in the transverse direction and $2L_G$, and the length of the body portion 1B in the transverse direction (i.e., in the transverse direction of FIG. 6) in plan view is equal to the sum of the length of the short longitudinal plate portion 31 in the transverse direction and $2L_G$.

Figure 13C:
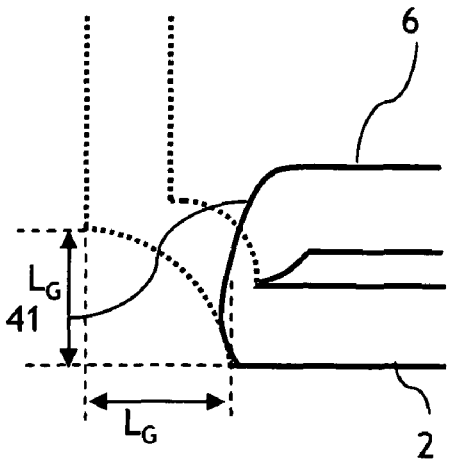

Moreover, FIG. 13C is a sectional view taken along XIII-XIII of FIG. 1A at the time when the body portion 1B is folded. When the body portion 1B is folded, as apparent from FIG. 13C, the concave portion 41 of the folding portion 9 hardly extends to the outer side of the long longitudinal plate portion 2. In other words, when the body portion 1B is folded, a concave portion G, which is defined by a portion 41 (the concave portion 41) of the folding portion 9, disappears.

Therefore, the size of the portion (see FIG. 6), which is surrounded by the long longitudinal plate portion 2 and the short longitudinal plate portion 31 of the body portion 1B at the time when the body portion 1B is assembled into the box shape, is larger by the size of the gap portion G of each folding portion than the size of the (rectangular) body portion 1B, as viewed in plan view, at the time when the body portion 1B is folded (the size of the sum L2 of the lengths of the long longitudinal plate portion 2 and the lower lid portion 4 in the longitudinal direction×the length L1 of the short longitudinal plate portion 31 in the transverse direction; see FIG. 9).

Moreover, the storage box 1A recovered can restore the box shape, when the body portion 1B is unfolded again, so that it can be reused.

Thus, the storage box 1A repeats the recovery and the reuse, the management information of which is recorded in the IC tag 18. The management information recorded may be read out during the physical distribution by the (not-shown) reader and may be managed in the (not-shown) information management center.

Here in the aforementioned embodiment, the body portion 1B of the storage box 1A is formed, when unfolded, into the rectangular shape in a top plan view, but may also be formed into a square shape in a top plan view. The invention can also be applied to a storage box 1A having a top plan shape other than that of this embodiment.

The aforementioned embodiment is constituted such that the body portion 1B is folded in its entirety by raising the lower lid portion 4, the upper lid portion 22 and the flaps 33 and 33 individually upward. However, the constitution can also be modified such that the lower lid portion, the upper lid portion and the flaps are individually felled down so that the body portion is folded in its entirety with the lower lid portion, the upper lid portion and the flaps individually overlapping the longitudinal plate portions.

In the foregoing embodiment, moreover, the binding margin portions 5 and 6 are formed at the long longitudinal plate portions 2 of the first member 1C and the second member 1D. However, the invention should not be limited thereto. The binding margin portions 5 and 6 need not be formed at the long longitudinal plate portion 2 but may also be formed on the right and left of each short longitudinal plate portion 31.

The foregoing description of the exemplary embodiments of the invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A storage box comprising:

a first member, a second member, and a pair of third members formed separately, and joined together by fasteners to assemble a main body portion;

the first member includes a first longitudinal plate portion, a first long bottom plate portion, and a lower lid portion;

the second member includes a second longitudinal plate portion, a second long bottom plate portion, and an upper lid portion; and each third member includes a short longitudinal plate portion, a short bottom plate portion, and a flap portion;

wherein the main body portion may be folded into a collapsible state from an operational state without removal of the fasteners;

the pair of long longitudinal plate portions being respectively formed with first valley-folding portions which extend in an upper and lower direction and which are formed to fold the long longitudinal plate portions inwardly, the long bottom plate portions continued from the long longitudinal plate portions being formed with mountain-folding portions so that the mountain-folding portions are located on extended lines of the first valley-folding portions, the mountain-folding portions being formed to fold the long bottom plate portions inwardly, the lid portions continued from the long longitudinal portions being formed with second valley-folding portions so that the second valley-folding portions are located on the extended lines of the first valley-folding portions, the second valley-folding portions being formed to fold the lid portions inwardly, wherein the long bottom plate portions continued from the long longitudinal plate portions are fixed to the short bottom plate portions continued from the short longitudinal plate portions, respectively, and a slit is formed in each long bottom plate portion extending from the long longitudinal plate portion so as to extend from a boundary between the first valley-folding portion and the mountain-folding portion, wherein the main body portion being able to be folded by raising or folding down the lid portions while raising the long bottom plate portions upward and by folding the first valley-folding portions, the mountain-folding portions and the second valley-folding portions.

2. The storage box according to claim 1, wherein the short bottom plate portions of the short longitudinal plate portions are formed with folding portions for raising the bottom plate portions upward.

3. The storage box according to claim 2, wherein each folding portion has about 45 degrees with respect to any of the sides of the corresponding short and long bottom plate portions.

4. The storage box according to claim 2, wherein the long bottom plate portions continued from the long longitudinal plate portions and the short bottom plate portions continued from the short longitudinal plate portions are fixed to each other in a vicinity of the folding portions.

5. The storage box according to claim 1, wherein the main body portion is formed by compression molding of recycled waste-paper.

6. The storage box according to claim 1, further comprising:

an Integrated Circuit (IC) tag attached to the main body portion.

7. The storage box according to claim 1, wherein no slit is formed in the long longitudinal plate portions, and the slit of each long bottom plate portion extending from the longitudinal plate portion does not reach an opposite end of each long bottom plate portion to the boundary the first valley-folding portion and the mountain-folding portion.

8. The storage box according to claim 1, wherein the slits are formed in the mountain-folding portions of the long bottom plate portions.

9. A storage box according comprising:

a first member, a second member, and a pair of third members formed separately, and joined together by fasteners to assemble a main body portion;

the first member includes a first longitudinal plate portion, a first long bottom plate portion, and a lower lid portion;

the second member includes a second longitudinal plate portion, a second long bottom plate portion, and an upper lid portion; and each third member includes a short longitudinal plate portion, a short bottom plate portion, and a flap portion;

wherein the main body portion may be folded into a collapsible state from an operational state without removal of the fasteners;

each of folding portions between the long longitudinal plate portions and the adjacent short longitudinal plate portions having a concave shape on an outside of each folding portion and having a convex shape on an inside of each folding portion, a length along each short longitudinal plate portion between the folding portions when the main body portion is folded is or less than a length along each short longitudinal plate portion between the folding portions when the main body portion is unfolded.

10. The storage box according to claim 9, wherein the folding portions in a state where the main body portion is unfolded extend more than those in a state where the main body portion is folded.

11. The storage box according to claim 10, wherein the folding portions extend by a size of gap.

12. The storage box according to claim 9, wherein in the state where the main body portion is unfolded, the folding portions are folded at both ends of convex portions.

* * * * *